United States Patent [19]

Cyr et al.

[11] Patent Number: 4,886,310

[45] Date of Patent: Dec. 12, 1989

[54] DOOR HANDLE FOR VEHICLE WITH FLUSH GLASS

[75] Inventors: Richard A. Cyr, Sterling Heights; Ronald J. Raley, Rochester, both of Mich.

[73] Assignee: General Motors Corporation, Detroit, Mich.

[21] Appl. No.: 209,235

[22] Filed: Jun. 20, 1988

[51] Int. Cl.[4] ..... E05B 1/00

[52] U.S. Cl. ..... 292/336.3; 292/DIG. 23; 292/DIG. 37

[58] Field of Search ..... 292/336.3, 170, DIG. 23, 292/DIG. 37, 30, 41, 53, 86, 119, 127, 135, 174, 227, 237; 70/214, 220

[56] References Cited

U.S. PATENT DOCUMENTS

| | | | |
|---|---|---|---|
| 748,119 | 2/1910 | Wettig | 292/227 X |
| 1,672,901 | 6/1928 | North | 292/227 |
| 2,304,145 | 12/1942 | Borchers | 292/336.3 |
| 2,337,894 | 12/1943 | Jacobi | 292/227 |
| 2,726,889 | 12/1955 | Lawson | 292/DIG. 37 X |
| 2,840,410 | 6/1958 | Jakeway | 292/336.3 |
| 3,054,634 | 9/1962 | Westerdale | 292/DIG. 37 X |
| 3,113,798 | 12/1963 | Kramer | 292/DIG. 37 X |
| 3,194,596 | 7/1965 | Jakeway | 292/DIG. 37 X |

FOREIGN PATENT DOCUMENTS

| | | | |
|---|---|---|---|
| 248744 | 1/1964 | Australia | 292/170 |
| 454454 | 4/1913 | France | 292/64 |
| 1483959 | 5/1965 | France | 292/41 |
| 154170 | 4/1956 | Sweden | 292/127 |

*Primary Examiner*—Gary L. Smith
*Assistant Examiner*—Eric K. Nicholson
*Attorney, Agent, or Firm*—Charles E. Leahy

[57] ABSTRACT

According to the present invention, a door handle assembly includes a handle mounted on the outside of the door panel and having a push button mounted on the handle and projecting outside the door panel to be accessible to the vehicle user. The push button is mounted for reciprocal movement to be pushed inwardly to a position inside the door panel when the push button is depressed. A door latch operating lever is mounted inside the door panel and operably connected to the door latch. The push button is hollow and has a cam surface provided on the inside thereof. The door latch operating lever has a cam follower portion extending through the door panel and into the inside of the push button to engage with the cam surface of the push button. When the push button is depressed, the cam surface pivots the operating lever to unlatch the door latch. Accordingly, the co-action between the push button and the operating lever occurs at a point outside the door panel, thereby enabling the door handle assembly to be configured to lessen its extent of intrusion into the vehicle door.

1 Claim, 1 Drawing Sheet

DOOR HANDLE FOR VEHICLE WITH FLUSH GLASS

The invention relates to a door handle assembly and more particularly to a door handle assembly which intrudes to a minimum extent on the inside of the door panel so that the window glass may be stored closely adjacent the door panel.

BACKGROUND OF THE INVENTION

In modern motor vehicles, particularly passenger cars, it is desirable that the window in the door have the glass as flush as possible with the outer panel of the door in order to streamline the vehicle's appearance. Furthermore, it is desirable to have a door which has a thin profile so that the interior width of the passenger compartment can be maximized in relation to the overall width of the vehicle.

One difficulty in obtaining the goal of a thin door with flush glass is that part of the door handle assembly mechanism for operating the door lock must be situated between the door outer panel and the lowered position of the glass. Therefore the size and configuration of the door handle dictates a certain clearance space between the door panel and the window panel. This problem is more complicated in the case of exterior door handles of the push button type because the push button also intrudes into the space between the door panel and the window panel.

Accordingly, it would be desirable to provide a new and improved door handle assembly of the push button type which would be configured to minimize the intrusion of the door handle operating mechanism into the space between the door panel and the window panel.

SUMMARY OF THE INVENTION

According to the present invention, a door handle assembly includes a handle mounted on the outside of the door panel and having a push button mounted on the handle and projecting outside the door panel to be accessible to the vehicle user. The push button is mounted for reciprocal movement to be pushed inwardly to a position inside the door panel when the push button is depressed. A door latch operating lever is mounted inside the door panel and operably connected to the door latch. The push button is hollow and has a cam surface provided on the inside thereof. The door latch operating lever has a cam follower portion extending through the door panel and into the inside of the push button to engage with the cam surface of the push button. When the push button is depressed, the cam surface pivots the operating lever to unlatch the door latch. Accordingly, the co-action between the push button and the operating lever occurs at a point outside the door panel, thereby enabling the door handle assembly to be configured to lessen its extent of intrusion into the vehicle door.

Accordingly, the object, feature, and avantage of the invention resides in the provision of a push button door handle assembly in which the latch operating cam arrangement between the push button and an operating lever occurs within a hollowed out portion of a push button and outside the confines of the door panel so that the door handle assembly is configured to extend into the door to a minimum extent.

BRIEF DESCRIPTION OF THE DRAWING

These and other objects, features and advantages of the invention will become apparent upon consideration of the description of the preferred embodiment and the appended drawings in which.

DESCRIPTION OF THE PREFERRED EMBODIMENT

Figure 1:
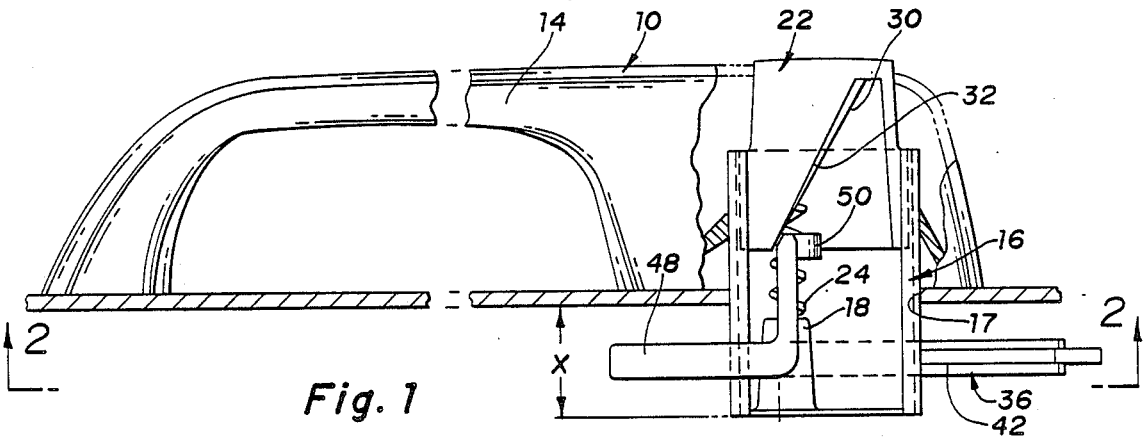
FIG. 1 is a plan view of the door handle assembly with parts broken away in section.

FIG. 1 shows a vehicle door handle assembly 10 mounted on a vehicle door outer panel 12. The door handle assembly 10 includes a handle 14, preferably of die cast material. A housing 16 is carried by the handle 14 and has a generally rectangular sleeve like configuration which extends through an aperture 17 in the door panel 12 so as to be situated both outside and inside the door panel 12. The housing 16 is suitably attached to the die cast handle 14 by rivets or suitable fastening means, not shown. The housing 16 has an integrally formed cylindrical spring seat 18 formed on the housing 16.

Figure 3:
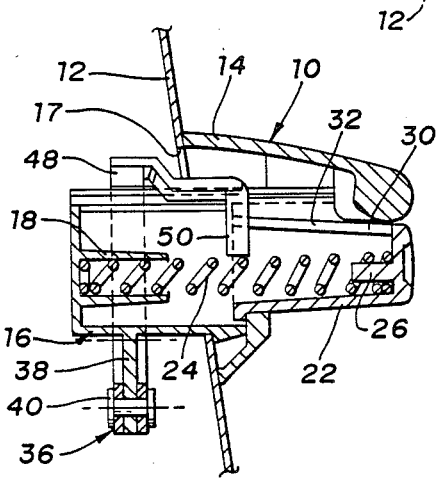
FIG. 3 is a sectional view taken through the door handle assembly in the direction of arrows 3—3 of FIG. 2.
Figure 5:
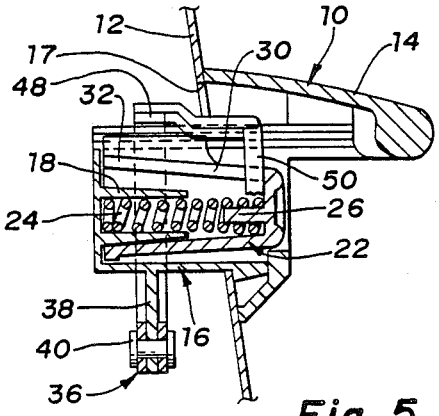
FIG. 5 is a view similar to FIG. 3 but showing the push button depressed.
Figure 4:
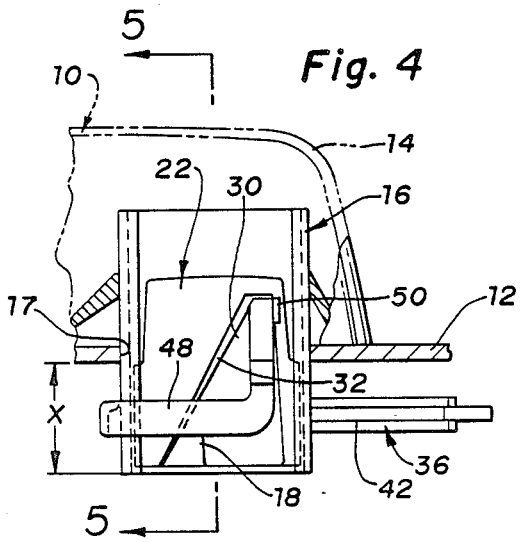
FIG. 4 is a partial fragmentary view of a door handle assembly similar to FIG. 1 but showing the push button depressed.

A push button 22, also preferably of die cast material, is captured in the housing 16 for reciprocable in and out movement. As best seen in FIG. 3, a coil compression spring 24 has one end seated in the cylindrical spring seat 18 of housing 16 and its other end seated upon an integral spring seat 26 provided on the inside of the push button 22. The spring 24 functions to urge the push button 22 to its extended position shown in FIGS. 1 and 3. As seen in the drawings, the push button 22 is hollow. The top wall of the push button 22 has a V-shaped cut-out 30 which defines a cam surface 32. The handle 14 overlies the cut-out 30 as shown in FIG. 3 to prevent entry of foreign material.

Figure 2:
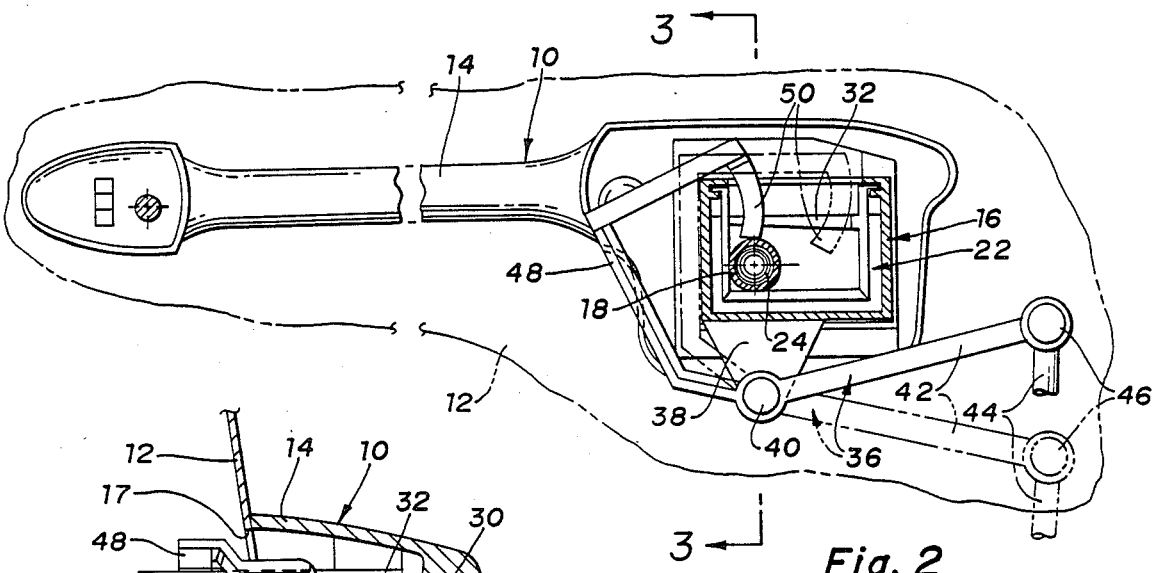
FIG. 2 is an elevation view of the door handle assembly viewed from inside the vehicle door with the door panel cut away and parts cut away and in section to show the normal push button extended position in solid line, and the push button depressed position in phantom line.

The push button 22 is connected to a door latch, not shown, by a door latch operating lever 36. The operating lever 36 is also a die casting and is pivotally mounted on a boss 38 of housing 16 by a pivot pin 40. As best seen in FIG. 2, the operating lever 36 includes operating arm 42 which is coupled to a latch control rod 44 by rivet 46. The operating lever 36 also includes a cam follower arm 48 carrying a cam follower 50 which reaches through the open top of housing 16 and is poised in the path of the cam surface 32 of push button 22.

As seen in FIG. 1, the cam follower 50 of operating lever 36 is poised in the path of the cam surface 32 when the push button 22 is established at its normal rest position by the coil spring 24.

When the vehicle user wishes to open the door, the handle 14 is gripped and the push button 22 is depressed by the user's thumb. The cam surface 32 carried inwardly by the push button 22 engages with the cam follower 50 and rotates the operating lever 36 in the counterclockwise direction as viewed in FIG. 2. Accordingly, as the operating lever pivots from its solid line indicated position of FIG. 2 to the phantom line indicated position during the depression of the push button 22, the latch rod 44 is pushed downwardly to operate the door latch.

When the operator releases the push button, spring 24 returns the push button to its extended position of FIGS. 1 and 3. A spring (not shown) associated with the door latch raises the latch rod 44 and rotates the operating lever 36 to its normal position of FIG. 1 and a solid line indicated position of FIG. 2.

As best viewed in FIG. 1, the aforedescribed arrangement of the door handle assembly 10 intrudes into the inside of the door by only the distance X so that the housing 16 and the operating lever 36 do not significantly intrude into proximity with the window glass stored inside the door. This minimum intrusion is made possible by the fact that the push button 22 is hollow so that the cam follower portion 50 of the operating lever 36 reaches through the door panel 12 and into the push button 22. Accordingly, by having the co-action between the push button cam surface 32 and the cam follower portion 50 occur outside the confines of the door panel 12, the handle mechanism can present a very thin profile and therefore intrude only minimally into the interior of the door.

It will be understood that although the various components of the door handle assembly shown here are constructed of die cast material such as zinc, other materials including plastic could be utilized to manufacture the door handle assembly.

The embodiments of the invention in which an exclusive property or privilege is claimed are defined as follows:

1. A motor vehicle door handle assembly mounted on a door panel for operating a door latch comprising:

a handle mounted on the door panel;

a push button mounted on the handle for movement between an extended position projecting outside the door panel to be accessible to the vehicle user and a depressed position, said push button having a cam surface formed on the interior thereof and being situated outside the door panel at least when the push button is in the extended position;

a door latch operating lever operably connected to the door latch and having a cam follower portion thereof extending outside the door panel and into the inside of the push button to engage with the cam surface of the push button;

pivot means pivotally mounting the operating lever for pivotal movement about an axis extending parallel to and laterally offset from the axis of movement of the push button so that the cam follower portion of the operating lever moves in a path normal to the axis of movement of the push button and remains outside of the door panel during pivotal movement of the operating lever by the interaction between the cam surface and the cam follower portion of the operating lever upon movement of the push button from the extended position to the depressed position; and spring means acting to urge the pushbutton to the extended position.

* * * * *